US008446098B2

(12) United States Patent
Shiu et al.

(10) Patent No.: US 8,446,098 B2
(45) Date of Patent: May 21, 2013

(54) LED DRIVING CIRCUIT

(75) Inventors: Shian-Sung Shiu, New Taipei (TW); Li-Min Lee, New Taipei (TW); Chung-Che Yu, New Taipei (TW); Xi Tu, Wuxi (CN); Ying Wang, Wuxi (CN)

(73) Assignee: Green Solution Technology Co., Ltd., New Taipei (TW)

( * ) Notice: Subject to any disclaimer, the term of this patent is extended or adjusted under 35 U.S.C. 154(b) by 99 days.

(21) Appl. No.: 13/244,653

(22) Filed: Sep. 25, 2011

(65) Prior Publication Data

US 2012/0268011 A1 Oct. 25, 2012

(30) Foreign Application Priority Data

Apr. 22, 2011 (CN) ..... 2011 1 0101593

(51) Int. Cl.
*H05B 41/16* (2006.01)

(52) U.S. Cl.
USPC ..... 315/247; 315/291; 315/185 S; 315/312; 315/282

(58) Field of Classification Search
USPC ..... 315/247, 246, 209 R, 224, 225, 274–279, 315/291, 297, 307–326, 185 S
See application file for complete search history.

(56) References Cited

U.S. PATENT DOCUMENTS

2011/0248648 A1* 10/2011 Liu ..... 315/294

* cited by examiner

*Primary Examiner* — Tuyet Thi Vo
(74) *Attorney, Agent, or Firm* — Jianq Chyun IP Office

(57) ABSTRACT

An LED driving circuit includes a first and a second LED modules, a first and a second switching converters, an extreme voltage detecting and selecting circuit, a current balance circuit and a controller. The first switching converter transforms electric power of an input power supply into a first output voltage for lighting the first LED module. The second switching converter transforms electric power of the input power supply into a second output voltage for lighting the second LED module. The current balance circuit balances the currents flowing through the first and the second LED modules. The extreme voltage detecting and selecting circuit detects the first and the second LED modules and selects to output one of detecting results. The controller controls the transforming of the first switching converter and the second switching converter to light the first and the second LED modules in response to the outputted detecting result.

12 Claims, 3 Drawing Sheets

LED DRIVING CIRCUIT

CROSS-REFERENCE TO RELATED APPLICATION

This application claims the priority benefit of China application serial no. 201110101593.7, filed on Apr. 22, 2011. The entirety of the above-mentioned patent application is hereby incorporated by reference herein and made a part of this specification.

BACKGROUND

1. Field of the Disclosure

The disclosure relates to a light emitting diode (LED) driving circuit. Particularly, the disclosure relates to an LED driving circuit using a single controller to drive a plurality of converters.

2. Description of Related Art

Referring to FIG. 1, FIG. 1 is a circuit schematic diagram of a conventional light emitting diode (LED) driving circuit. The LED driving circuit includes a controller 100, a first boost converter 160*a*, a second boost converter 160*b*, a common output capacitor C, a first LED string 150*a*, a second LED string 150*b*, a lowest voltage selecting circuit 140 and a current balance circuit 145. The first boost converter 160*a* is a direct current (DC) to DC boost converter, which includes an inductor La, a switch SWa and a rectifier device Da. One end of the inductor La is coupled to a DC input voltage Vin, and another end thereof is coupled to one end of the switch SWa, and another end of the switch SWa is coupled to ground. A positive end of the rectifier device Da is coupled to a connecting point of the inductor La and the switch SWa, and a negative end thereof is coupled to the common output capacitor C. The second boost converter 160*b* is a DC to DC boost converter, which includes an inductor Lb, a switch SWb and a rectifier device Db, where coupling/connection relations among the inductor Lb, the switch SWb and the rectifier device Db are the same to that of the first boost converter 160*a*. The common output capacitor C receives electric power transmitted by the first boost converter 160*a* and the second boost converter 160*b* to generate an output voltage Vout, so as to light the first LED string 150*a* and the second LED string 150*b*.

The current balance circuit 145 is coupled to negative ends of the first LED string 150*a* and the second LED string 150*b* to balance currents flowing through the first LED string 150*a* and the second LED string 150*b*, so as to equalize lighting effects of the first LED string 150*a* and the second LED string 150*b*. The lowest voltage selecting circuit 140 is coupled to the negative ends of the first LED string 150*a* and the second LED string 150*b* for detecting and determining a lowest voltage of the voltages of the negative ends, and accordingly outputs a detecting signal VFB. The controller 100 generates a switching signal Sc according to the detecting signal VFB so as to control switching operations of the switches SWa and SWb.

An advantage of the above circuit structure is that the single controller can be used to drive a plurality of converters to provide larger driving capability to drive more LEDs. Since output terminals of the converters are connected to each other, in case that the converters cannot provide the same power due to different electrical characteristics of devices caused by process errors, the converter providing more power can compensate the converter providing less power, so as to improve a whole efficiency of the LED driving circuit in theory.

Input terminals of the converters are coupled to a same DC input voltage Vin, and the output terminals thereof are connected to each other. Since the output terminals of the converters are connected to each other, the same output voltage Vout is output. The converters are switched in response to the same switching signal Sc. A conversion ratio is Vout/Vin=1/(1−D), where D is a duty cycle of the switching signal Sc. Under an ideal state, the input voltage Vin, the output voltage Vout and the duty cycle D are all the same, and so currents of the inductors La and Lb are the same. However, due to process errors, conducting impedances, threshold voltages and parasitic capacitances of the switches SWa and SWb are different, inductances and parasitic resistances of the inductors La and Lb are different, and forward conducting voltages of the rectifier devices Da and Db are different, and these differences may cause different conversion ratios of the converters, and in case that the output terminals of the converters are connected to output the same output voltage Vout, a current difference between the inductor La and the inductor Lb is enlarged.

The current difference between the inductor La and the inductor Lb may cause different temperature increases of the switches SWa and SWb, and the rectifier devices Da and Db due to different heat generated thereon, or may even cause magnetic saturation on one of the inductor La or the inductor Lb with the highest current to reduce the conversion efficiency due to excessively large current. Moreover, in some application environments that the temperature increases on components are limited, for example, a backlight module of a liquid crystal display (LCD). These application environments must use a better metal-oxide-semiconductor field-effect transistor (MOSFET) (with lower conducting impedance) to suppress the heat generated by the MOSFETs, so that the cost of the LED driving circuit is increased.

SUMMARY OF THE DISCLOSURE

As the input terminals and the output terminals of the converters in the light emitting diode (LED) driving circuit of the related art are respectively connected, a current difference there between is enlarged due to process errors of the devices, which may cause large temperature increases and difference of the switches and the rectifier devices to reduce the conversion efficiency. In the disclosure, the output terminals of the converters are separated to drive different LED modules, so as to reduce the current difference of the converters to reduce the temperature increases and difference of the switches and the rectifier devices and improve the conversion efficiency. In the disclosure, a plurality of rectifier diodes connected in series can be used as the rectifier device, so as to improve the conversion efficiency of the LED driving circuit.

The disclosure provides a light emitting diode (LED) driving circuit. The LED driving circuit includes a first LED module, a second LED module, a first switching converter, a second switching converter, an extreme voltage detecting and selecting circuit, a current balance circuit and a controller. The first switching converter has a first input terminal coupled to an input power supply and a first output terminal coupled to the first LED module, and is adapted to transform electric power of the input power supply into a first output voltage for lighting the first LED module.

The second switching converter has a second input terminal coupled to the input power supply and a second output terminal coupled to the second LED module, and is adapted to transform the electric power of the input power supply into a second output voltage for lighting the second LED module. The current balance circuit is coupled to the first LED module and the second LED module for balancing currents flowing through the first LED module and the second LED module. The extreme voltage detecting and selecting circuit is coupled to the first LED module and the second LED module, and adapted for detecting the first LED module and the second LED module, and selecting to output one of detecting results. The controller is coupled to the extreme voltage detecting and selecting circuit, and adapted for controlling the transforming of the first switching converter and the second switching converter to respectively light the first LED module and the second LED module in response to the output of the extreme voltage detecting and selecting circuit.

The disclosure provides an LED driving circuit including a first LED module, a second LED module, a first switching converter, a second switching converter, a current balance circuit, an extreme voltage detecting and selecting circuit and a controller. The first switching converter has a first input terminal coupled to an input power supply and a first output terminal. The second switching converter has a second input terminal coupled to the input power supply and a second output terminal, where the first switching converter and the second switching converter respectively have a rectifier device for rectifying electric power of the input power supply, the rectifier device includes a plurality of diodes connected in series, and the first output terminal of the first switching converter and the second output terminal of the second switching converter are coupled to each other to jointly light the first LED module and the second LED module. The current balance circuit is coupled to the first LED module and the second LED module for balancing currents flowing through the first LED module and the second LED module. The extreme voltage detecting and selecting circuit is coupled to the first LED module and the second LED module, and adapted for detecting the first LED module and the second LED module, and selecting to output one of detecting results. The controller is coupled to the extreme voltage detecting and selecting circuit, and adapted for generating a control signal to control the transforming of the first switching converter and the second switching converter in response to the output of the extreme voltage detecting and selecting circuit.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
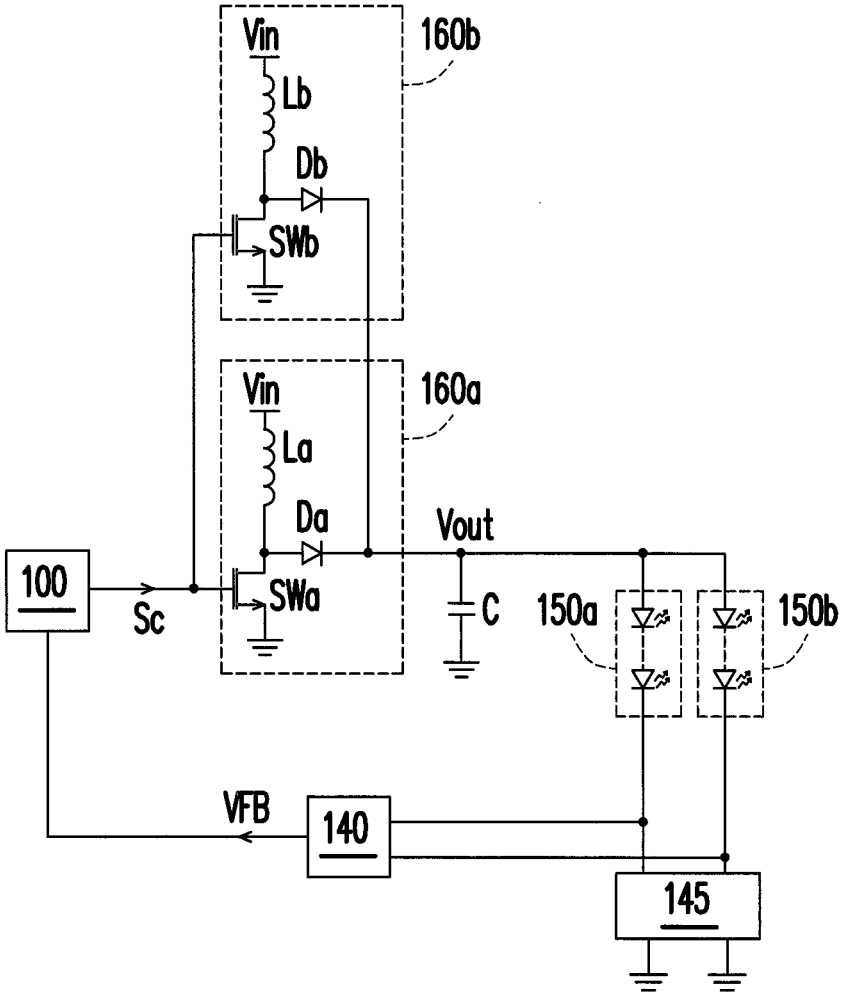
FIG. 1 (RELATED ART)
FIG. 1 is a circuit schematic diagram of a conventional light emitting diode (LED) driving circuit.

Reference will now be made in detail to the present preferred embodiments of the invention, examples of which are illustrated in the accompanying drawings. Wherever possible, the same reference numbers are used in the drawings and the description to refer to the same or like parts.

Figure 2:
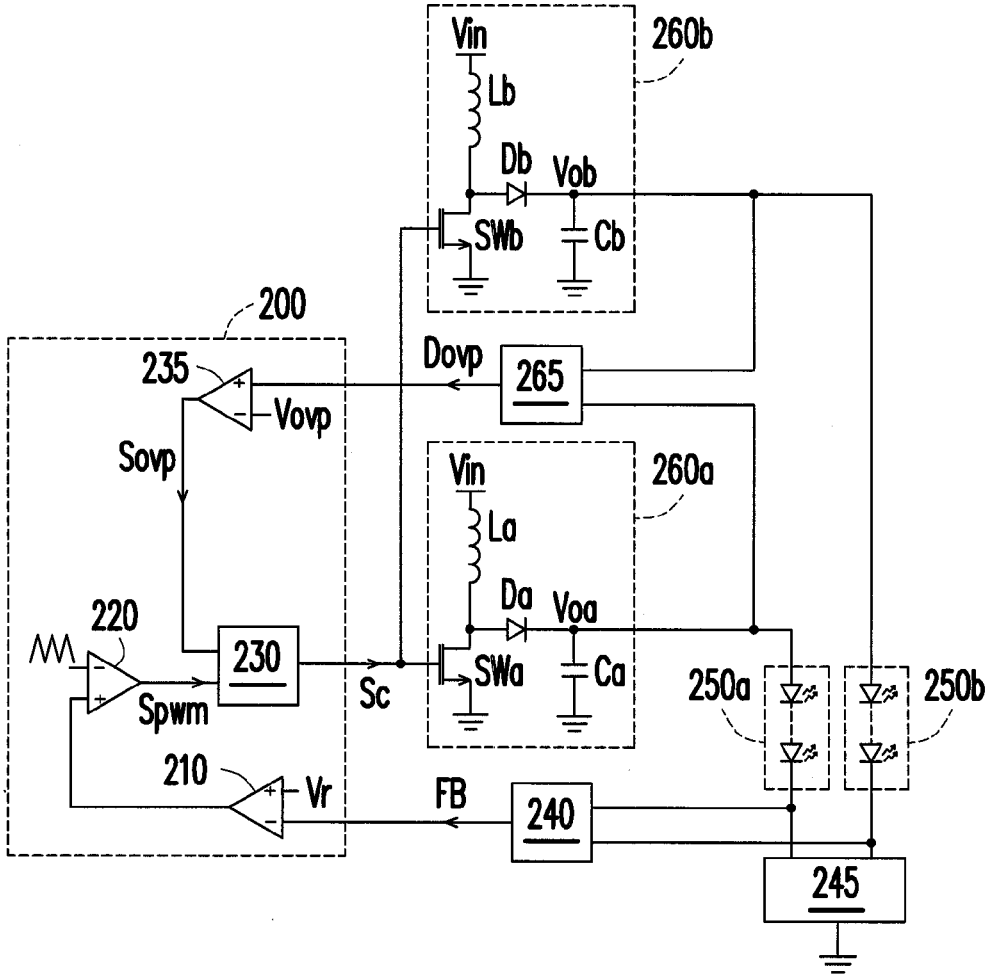
FIG. 2 is a circuit schematic diagram of an LED driving circuit according to a first exemplary embodiment of the disclosure.

Referring to FIG. 2, FIG. 2 is a circuit schematic diagram of a light emitting diode (LED) driving circuit according to a first exemplary embodiment of the disclosure. The LED driving circuit includes a first LED module 250*a*, a second LED module 250*b*, a first switching converter 260*a*, a second switching converter 260*b*, an extreme voltage detecting and selecting circuit 240, a current balance circuit 245 and a controller 200. The first switching converter 260*a* has a first input terminal coupled to an input power supply Vin and a first output terminal coupled to the first LED module 250*a*, and is adapted to transform electric power of the input power supply Vin into a first output voltage Voa for lighting the first LED module 250*a*. The first switching converter 260*a* is a direct current (DC) to DC boost converter and includes an inductor La, a switch SWa, a rectifier device Da and a first output capacitor Ca. One end of the inductor La is coupled to the input power supply Vin, and another end thereof is coupled to one end of the switch SWa, and another end of the switch SWa is coupled to ground. A positive end of the rectifier device Da is coupled to a connecting point of the inductor La and the switch SWa, and a negative end thereof is coupled to the first output capacitor Ca. The second switching converter 260*b* has a second input terminal coupled to the input power supply Vin and a second output terminal coupled to the second LED module 250*b*, and is adapted to transform the electric power of the input power supply Vin into a second output voltage Vob for lighting the second LED module 250*b*. The second switching converter 260*b* is also a DC to DC boost converter and includes an inductor Lb, a switch SWb, a rectifier device Db and a second output capacitor Cb. One end of the inductor Lb is coupled to the input power supply Vin, and another end thereof is coupled to one end of the switch SWb, and another end of the switch SWb is coupled to the ground. A positive end of the rectifier device Db is coupled to a connecting point of the inductor Lb and the switch SWb, and a negative end thereof is coupled to the second output capacitor Cb. The current balance circuit 245 is coupled to the first LED module 250*a* and the second LED module 250*b* to adjust cross-voltages of the first LED module 250*a* and the second LED module 250*b* in response to LEDs therein, and so currents flowing through the first LED module 250*a* and the second LED module 250*b* are approximately/substantially the same. Since the current balance circuit 245 has a minimum operation voltage limitation, the extreme voltage detecting and selecting circuit 240 is coupled to the first LED module 250*a* and the second LED module 250*b*, and adapted for detecting potentials of a connecting point of the first LED module 250*a* and the current balance circuit 245 and a connecting point of the second LED module 250*b* and the current balance circuit 245, and selecting to output a detecting signal indicative of the potential of the connecting point of the LED module with the highest driving voltage. In the present exemplary embodiment, the extreme voltage detecting and selecting circuit 240 is connected to negative ends of the first LED module 250*a* and the second LED module 250*b*, so that the extreme voltage detecting and selecting circuit 240 selects a connecting point with a lowest voltage to output a feedback signal FB indicative of the potential of the connecting point. The controller 200 is coupled to the extreme voltage detecting and selecting circuit 240, and adapted to control the first switching converter 260*a* and the second switching converter 260*b* for respectively generating the first output voltage Voa and the second output voltage Vob to respectively light the first LED module 250*a* and the second LED module 250*b* in response to the output (i.e. the feedback signal FB) of the extreme voltage detecting and selecting circuit 240.

The controller 200 includes an error amplifier 210, a pulse width comparator 220 and a driving circuit 230. The error amplifier 210 receives a reference voltage signal Vr and the feedback signal FB, and accordingly generates a pulse width modulation (PWM) signal. The pulse width comparator 220 receives the PWM signal and a ramp signal to generate a pulse width control signal Spwm. The driving circuit 230 generates a control signal Sc according to the pulse width control signal Spwm so as to simultaneously control switching operations of the switches SWa and SWb. The above feedback control ensures that the current balance circuit 245 is successfully operated at or over the operable minimum voltage to balance the currents flowing through the first LED module 250*a* and the second LED module 250*b*.

Moreover, in order to avoid the first output voltage Voa and the second output voltage Vob respectively generated by the first switching converter 260*a* and the second switching converter 260*b* to be excessively high, an over-voltage detecting and selecting circuit 265 is added and coupled to the first switching converter 260*a* and the second switching converter 260*b*. The over-voltage detecting and selecting circuit 265 is used to detect the first output voltage Voa and the second output voltage Vob and select a highest one to output an over-voltage detecting signal Dovp indicative of the highest one. Accordingly, the controller 200 further includes an over-voltage comparator 235, and the over-voltage comparator 235 receives the over-voltage detecting signal Dovp and an over-voltage reference signal Vovp, and when a level of the over-voltage detecting signal Dovp is higher than a level of the over-voltage reference signal Vovp, the over-voltage comparator 235 generates an over-voltage protection signal Sovp to the driving circuit 230, such that the driving circuit 230 would stop switching the switches SWa and SWb, so as to stop the transforming operations of the first switching converter 260*a* and the second switching converter 260*b*.

Certainly, the concept of the disclosure can be applied to three or more converters, and the converters are controlled by a single controller, and input terminals thereof are all coupled to a same input power supply and output terminals thereof are independent to each other to drive the corresponding LED modules, which is a circuit variation of the related art known by those skilled in the art, and details thereof are not repeated.

According to the above descriptions, it is known that the single controller is used to control two or more converters to respectively drive the corresponding LED modules, where the output terminals of the converters are independent to each other. Therefore, each converter is only required to provide power to the corresponding LED module. Although the driving power required by each LED module is slightly different, the difference is not great as the LED manufacturer classify the LEDs according to respective threshold voltages. Therefore, the heat generated by the switch and the rectifier device of each converter is similar, so that a temperature difference due to the difference of the temperature increases is relatively small compared to that of the conversional art. Meanwhile, the problem of conversion efficiency reduction due to magnetic saturation caused by relatively large inductor current can be avoided.

Figure 3:
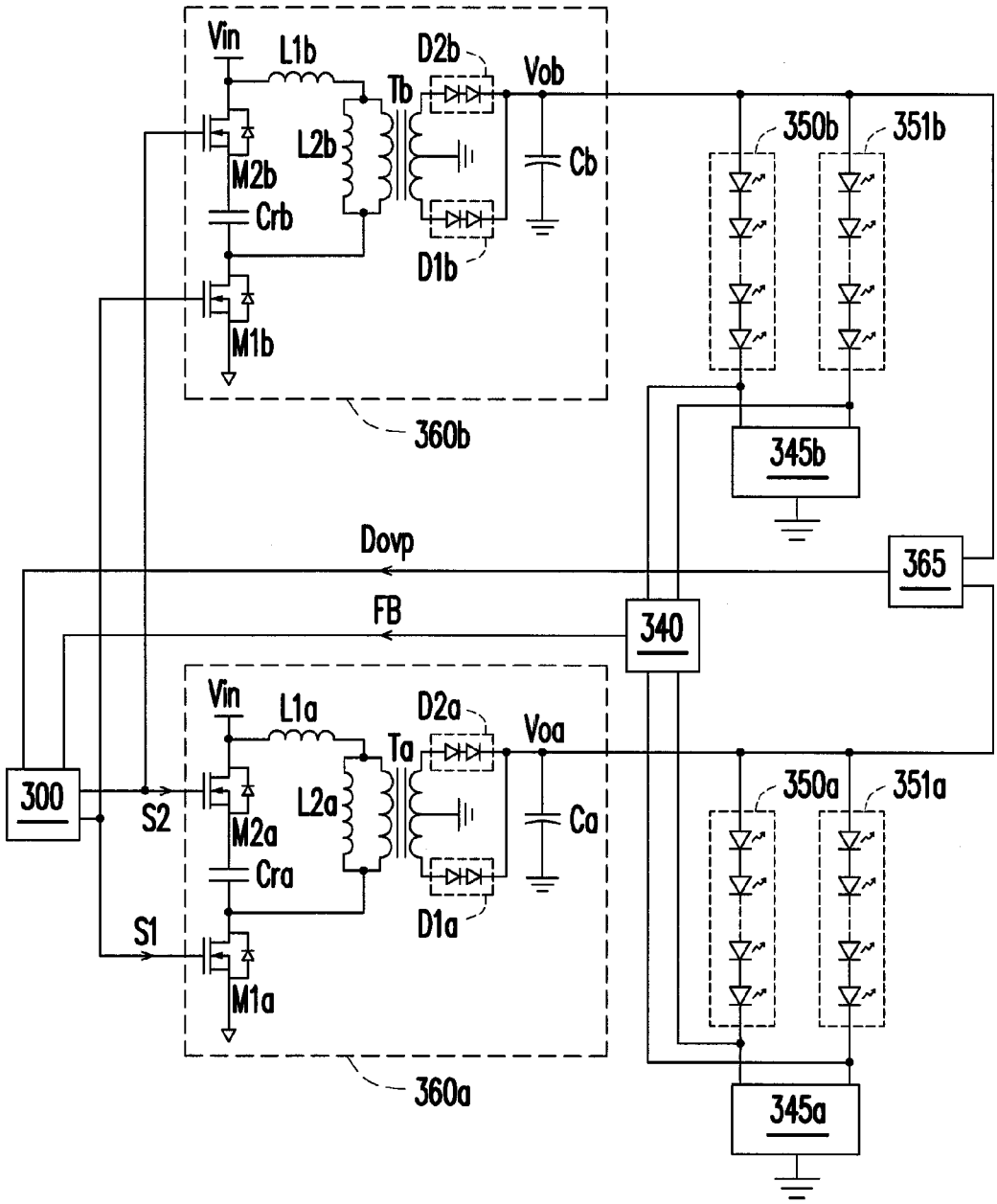
FIG. 3 is a circuit schematic diagram of an LED driving circuit according to a second exemplary embodiment of the disclosure.

Then, referring to FIG. 3, FIG. 3 is a circuit schematic diagram of an LED driving circuit according to a second exemplary embodiment of the disclosure. Compared to the embodiment of FIG. 2, a main difference is that the converter is changed to an LLC resonant converter.

A first switching converter 360*a* is a half bridge LLC resonant converter, which includes a first switch M1*a*, a second switch M2*a*, an LLC resonant circuit composed of a serial inductor L1*a*, a parallel inductor L2*a* and a resonant capacitor Cra, a transformer Ta, rectifier devices D1*a* and D2*a*, and a first output capacitor Ca. Similarly, a second switching converter 360*b* is also a half bridge LLC resonant converter, which includes a first switch M1*b*, a second switch M2*b*, an LLC resonant circuit composed of a serial inductor L1*b*, a parallel inductor L2*b* and a resonant capacitor Crb, a transformer Tb, rectifier devices D1*b* and D2*b*, and a second output capacitor Cb. Herein, the coupling/connection relations among the switch M1*a*/M2*a* and M1*b*/M2*b*, the inductor L1*a*/L2*a* and L1*b*/L2*b*, the capacitors Cra/Crb and Ca/Cb, the transformer Ta/Tb, and the rectifier devices D1*a*/D2*a* and D2*a*/D2*b* are shown in FIG. 3, such that the detail descriptions thereof would be omitted. In the present exemplary embodiment, by using the half bridge LLC resonant converters, zero voltage switching of the converters can be achieved to improve the efficiency. Each of the rectifier devices includes two diodes connected in series, though in an actual application, more diodes can be coupled in series to form the rectifier device. By connecting a plurality of diodes in series, the diodes can share the cross-voltage when a negative-biased voltage is applied to the rectifier devices. Reduction of the cross-voltage may lead to reduction of the power consumption caused by charging/discharging of the parasitic capacitances of the diodes, especially under an application structure of a high output voltage, the conversion efficiency of the converter can be obviously improved. Therefore, each of the rectifier devices Da and Db of the exemplary embodiment of FIG. 2 can also be formed by two or more diodes connected in series, or even the conventional circuit structure (for example, the LED driving circuit shown in FIG. 1) can also use such manner to improve the conversion efficiency of the converter.

Current balance circuits 345*a* and 345*b* are respectively coupled to LED strings 350*a* and 351*a* of the first LED module and LED strings 350*b* and 351*b* of the second LED module to balance currents flowing through the LED stings. An extreme voltage detecting and selecting circuit 340 is coupled to the LED strings 350*a*, 351*a*, 350*b* and 351*b*, and adapted for detecting potentials of connecting points of the current balance circuits 345*a* and 345*b* and the LED strings 350*a*, 351*a*, 350*b* and 351*b*, and selecting the connecting point with a lowest voltage to output a feedback signal FB indicative of the lowest voltage. A controller 300 is coupled to the extreme voltage detecting and selecting circuit 340, and adapted for generating a first control signal S1 and a second control signal S2 to control the first switches M1*a* and M1*b* of the first switching converter 360*a* and the second switches M2*a* and M2*b* of the second switching converter 360*b* in response to the output (i.e. the feedback signal FB) of the extreme voltage detecting and selecting circuit 340, such that the first switching converter 360*a* and the second switching converter 360*b* respectively generate a first output voltage Voa and a second output voltage Vob to respectively light the first LED module and the second LED module. In other words, the first switching converter 360*a* is used to transform the electric power of the input power supply Vin into the first output voltage Voa for lighting the first LED module (i.e. the LED strings 350*a* and 351*a*); and the second switching converter 360*b* is used to transform the electric power of the input power supply Vin into the second output voltage Vob for lighting the second LED module (i.e. the LED strings 350*b* and 351*b*).

Certainly, in the present exemplary embodiment, an over-voltage detecting and selecting circuit 365 can be added and coupled to the first switching converter 360*a* and the second switching converter 360*b*. The over-voltage detecting and selecting circuit 365 is used to detect the first output voltage Voa and the second output voltage Vob, and select a highest one to output an over-voltage detecting signal Dovp indicative of the highest one. The controller 300 stops generating the first control signal S1 and the second control signal S2 to stop switching the switches M1*a*, M1*b*, M2*a* and M2*b* when determining that any one of the first output voltage Voa and the second output voltage Vob is higher than a predetermined over-voltage protection value (i.e. the over-voltage detecting signal Dovp is higher than the predetermined over-voltage protection value), so as to stop the transforming operations of the first switching converter 360*a* and the second switching converter 360*b*.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A light emitting diode (LED) driving circuit, comprising:

a first LED module;

a second LED module;

a first switching converter, having a first input terminal coupled to an input power supply and a first output terminal coupled to the first LED module, and adapted to transform electric power of the input power supply into a first output voltage for lighting the first LED module;

a second switching converter, having a second input terminal coupled to the input power supply and a second output terminal coupled to the second LED module, and adapted to transform the electric power of the input power supply into a second output voltage for lighting the second LED module;

a current balance circuit, coupled to the first LED module and the second LED module, for balancing currents flowing through the first LED module and the second LED module;

an extreme voltage detecting and selecting circuit, coupled to the first LED module and the second LED module, for detecting the first LED module and the second LED module and selecting to output one of detecting results; and a controller, coupled to the extreme voltage detecting and selecting circuit, for controlling transforming of the first switching converter and the second switching converter to respectively light the first LED module and the second LED module in response to the output of the extreme voltage detecting and selecting circuit.

2. The LED driving circuit as claimed in claim 1, further comprising:

an over-voltage detecting and selecting circuit coupled to the first switching converter and the second switching converter, for detecting one of the first output voltage and the second output voltage and selecting to output one of detecting results, wherein the controller determines whether or not to stop the transforming of the first switching converter and the second switching converter according to the output of the over-voltage detecting and selecting circuit.

3. The LED driving circuit as claimed in claim 2, wherein the extreme voltage detecting and selecting circuit is coupled to negative ends of the first LED module and the second LED module, and adapted for detecting the negative ends and selecting to output a signal indicative of the lowest voltage thereof.

4. The LED driving circuit as claimed in claim 2, wherein the first switching converter and the second switching converter are direct current (DC) to DC boost converters.

5. The LED driving circuit as claimed in claim 2, wherein the first switching converter and the second switching converter are LLC resonant converters.

6. The LED driving circuit as claimed in claim 1, wherein the controller generates a control signal in response to the output of the extreme voltage detecting and selecting circuit to simultaneously control transforming of the first switching converter and the second switching converter.

7. The LED driving circuit as claimed in claim 1, wherein each of the first switching converter and the second switching converter has a rectifier device for rectifying the electric power of the input power supply, and the rectifier device comprises a plurality of diodes connected in series.

8. The LED driving circuit as claimed in claim 1, further comprising:

a third LED module; and a third switching converter, having a third input terminal coupled to the input power supply and a third output terminal coupled to the third LED module, and adapted to transform the electric power of the input power supply into a third output voltage for lighting the third LED module, wherein the extreme voltage detecting and selecting circuit is further coupled to the third LED module for detecting the third LED modules and selecting to output one of detecting results; and wherein the controller further controls transforming of the first switching converter, the second switching converter and the third switching converter to respectively light the first LED module, the second LED module and the third LED module in response to the output of the extreme voltage detecting and selecting circuit.

9. The LED driving circuit as claimed in claim 8, wherein the controller generates a control signal in response to the output of the extreme voltage detecting and selecting circuit to simultaneously control transforming of the first switching converter, the second switching converter and the third LED module.

10. The LED driving circuit as claimed in claim 8, wherein each of the first switching converter, the second switching converter and the third switching converter has a rectifier device for rectifying the electric power of the input power supply, and the rectifier device comprises a plurality of diodes connected in series.

11. A light emitting diode (LED) driving circuit, comprising:

a first LED module;

a second LED module;

a first switching converter, having a first input terminal coupled to an input power supply and a first output terminal;

a second switching converter, having a second input terminal coupled to the input power supply and a second output terminal, wherein each of the first switching converter and the second switching converter has a rectifier device for rectifying electric power of the input power supply, the rectifier device comprises a plurality of diodes connected in series, and the first output terminal of the first switching converter and the second output terminal of the second switching converter are coupled to each other to jointly light the first LED module and the second LED module;

a current balance circuit, coupled to the first LED module and the second LED module, for balancing currents flowing through the first LED module and the second LED module;

an extreme voltage detecting and selecting circuit, coupled to the first LED module and the second LED module, for detecting the first LED module and the second LED module and selecting to output one of detecting results; and a controller, coupled to the extreme voltage detecting and selecting circuit, for generating a control signal to simultaneously control transforming of the first switching converter and the second switching converter in response to the output of the extreme voltage detecting and selecting circuit.

12. The LED driving circuit as claimed in claim 11, further comprising:

a third LED module; and a third switching converter, having a third input terminal coupled to the input power supply and a third output terminal coupled to the first output terminal of the first switching converter and the second output terminal of the second switching converter, for jointly lighting the first LED module, the second LED module and the third LED module, wherein the extreme voltage detecting and selecting circuit is further coupled to the third LED module for detecting the third LED modules and selecting to output one of detecting results; and wherein the controller further generates the control signal to control transforming of the first switching converter, the second switching converter and the third switching circuit in response to the output of the extreme voltage detecting and selecting circuit.

* * * * *